United States Patent [19]

Seals et al.

[11] Patent Number: 4,924,970

[45] Date of Patent: May 15, 1990

[54] LADDER APPARATUS

[76] Inventors: William L. Seals, 652 E. Cornell Ave., Fresno, Calif. 93704; Brad A. Seals, 6163 N. Dewey Ave., Fresno, Calif. 93711

[21] Appl. No.: 321,000

[22] Filed: Mar. 9, 1989

[51] Int. Cl.[5] ..... A47B 77/10; E06C 1/12; E06C 9/00

[52] U.S. Cl. ..... 182/91; 182/97; 182/156; 182/195; 182/207

[58] Field of Search ..... 182/35, 91, 97, 156, 182/195, 107, 108, 207, 90

[56] References Cited

U.S. PATENT DOCUMENTS

| | | | |
|---|---|---|---|
| 1,946,747 | 2/1934 | Laborda | 182/35 |
| 2,775,499 | 12/1956 | Gleitsman | 182/35 |
| 2,881,040 | 4/1959 | Hartridge | 182/35 |
| 3,311,190 | 3/1967 | Naumann | 182/129 |
| 3,481,429 | 12/1969 | Gaede | 182/129 |
| 4,079,815 | 3/1978 | Cormier | 182/195 |

FOREIGN PATENT DOCUMENTS

| | | | |
|---|---|---|---|
| 745837 | 3/1956 | United Kingdom | 182/129 |

*Primary Examiner*—Reinaldo P. Machado
*Attorney, Agent, or Firm*—Worrel & Worrel

[57] ABSTRACT

A ladder apparatus adapted to be borne by a fixture, such as cabinet, including a bracket adapted to be mounted on the fixture, a pair of first support members individually, substantially pivotally mounted on the bracket, a pair of second support members individually slidably mounted on the first support members, and a pair of third support members individually, slidably mounted on the second pair of support members and at least one step mounted on and interconnecting the third support members whereby the apparatus can be disposed in a collapsed, stored attitude inside a cabinet or alternatively extended therefrom and disposed in an operational attitude extending outside the cabinet.

11 Claims, 4 Drawing Sheets

FIG. 7
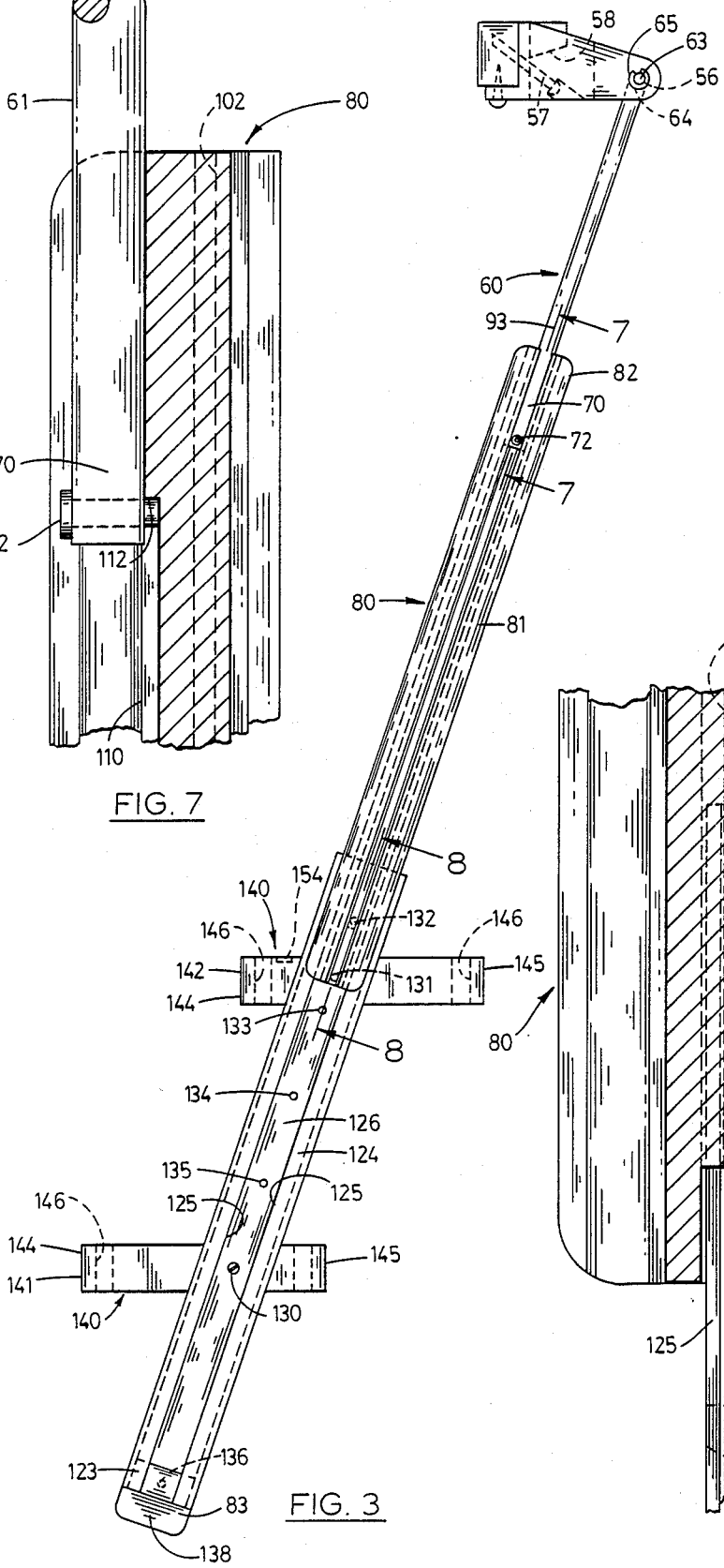
FIG. 3
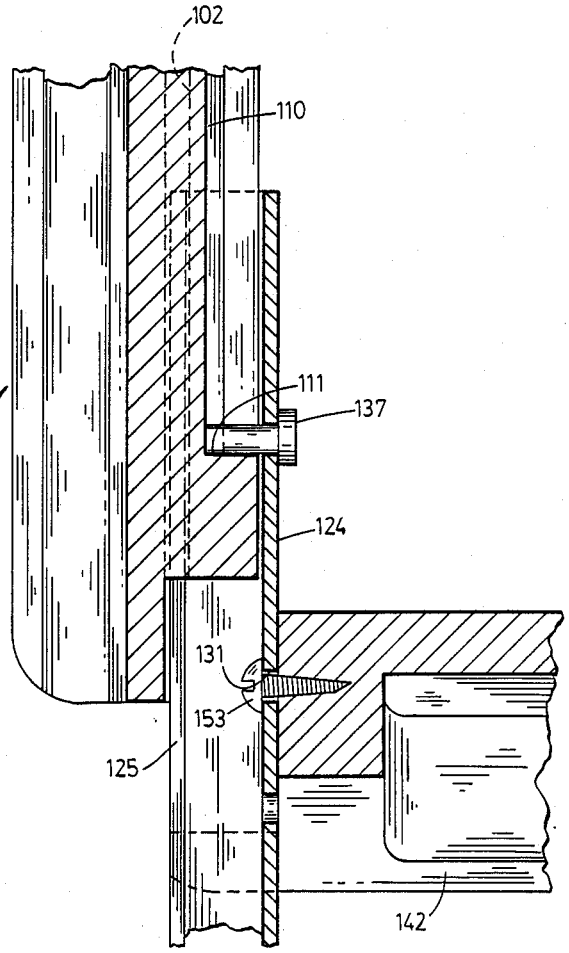
FIG. 8

LADDER APPARATUS

BACKGROUND OF THE INVENTION

1. Field of the Invention:

The present invention relates to a ladder apparatus having particular utility in use by children, and more particularly to such a ladder apparatus adapted to be mounted inside a cabinet and which can be received in the cabinet in a retracted, stored configuration, and which, alternatively, can be disposed in an operational attitude extending from the cabinet for use in gaining access to an elevated area such as a sink above the cabinet.

2. Description of the Prior Art:

Ladders and similar devices have, of course, long been employed in gaining access to elevated areas. Recently, there have been advances in ladder construction achieving a variety of objectives including improved safety, greater flexibility of use, reduced weight and the like. For example, such advances have included ladders which have hinged joints permitting the ladder to be formed into a scaffolding, or into other configurations. Other advances include ladders which can be disposed in attitudes such as to impart greater lateral support and/or so as to position the ladder in an attitude immediately adjacent to, but not contacting a structure to which access is required.

Although there have been significant advances in ladder construction for both home and commercial use, there are certain environments, such as in the home, where unique needs have not been addressed. For example, there are situations in the home in which a particular location requires frequent access, but in which it is inconvenient or unsightly to employ a normal ladder or stool. Furthermore, bulky conventional ladders, when brought into the home, are unwieldy frequently leading to damage to woodwork, fixtures and the like.

Children, particularly at young ages, require assistance in reaching sinks, counter tops and the like for purposes of washing their hands, brushing their teeth, getting a drink of water or the like. Parents typically provide children with a short stool or other similar piece of furniture such that the child may stand upon it to gain access to the elevated area. In other instances, children without parental supervision utilize chairs, boxes or stand on opened drawers in order to reach such areas. The dangers attendant to such activities are obvious.

Therefore it has long been known that it would be desirable to have an improved ladder apparatus which is particularly well suited to permit children or others to gain access to elevated areas such as sinks and counter tops, which is operable, conveniently to be stored, which is operable when disposed in an operational configuration to provide a safe means by which a child or other person can gain access to the elevated location, and which affords a means by which a child can do so without risk of damage to walls, woodwork, fixtures or the like in an apparatus which is relatively inexpensive to manufacture and maintain and is characterized by an ease of utilization.

SUMMARY OF THE INVENTION

Therefore, it is an object of the present invention to provide an improved ladder apparatus.

Another object is to provide such a ladder apparatus which can be disposed in a concealed, stored attitude or alternatively placed in a secure operational attitude.

Another object is to provide such a ladder apparatus which is particularly well suited for use by children and others providing a safe and stable structure upon which they can climb and stand.

Another object is to provide such a ladder apparatus which is characterized by simplicity of design, ease of employment and which can be manufactured and sold at a relatively nominal cost.

Another object is to provide a ladder apparatus which is adapted for attachment to a fixture, such as a cabinet, cupboard, or the like, in such a manner that it can be stored in a concealed manner when not in use, but which can conveniently be extended for use from the fixture without damage to surrounding surfaces and disposed in an operational attitude which is entirely stable and dependable for use.

Further objects and advantages are to provide improved elements and arrangements thereof in a ladder apparatus for the purposes described which is dependable, economical, durable, safe and fully effective in accomplishing its intended purposes.

These and other objects and advantages are achieved in a ladder apparatus, in the preferred embodiment, which is adapted to be mounted inside a cabinet or the like, the apparatus having a bracket mounted inside the cabinet and which mounts a first support member for substantially pivotal movement therewith; and a second support member mounting a step and having a longitudinal axis which slidably mounts the first support member for substantially coaxial movement therewith, the first and second members permitting the apparatus to be disposed in a substantially concealed, stored attitude inside the cabinet or alternatively in an operational attitude outside the cabinet for the purpose of providing a convenient means by which a child or other person can reach an elevated area in safety.

BRIEF DESCRIPTION OF THE DRAWINGS

FIG. 3 is a transverse vertical section taken on line 3—3 in FIG. 1.

FIG. 7 is a somewhat enlarged fragmentary longitudinal section taken on line 7—7 in FIG. 3.

FIG. 8 is a somewhat enlarged fragmentary longitudinal section taken on line 8—8 in FIG. 3.

DESCRIPTION OF THE PREFERRED EMBODIMENT

Figure 1:
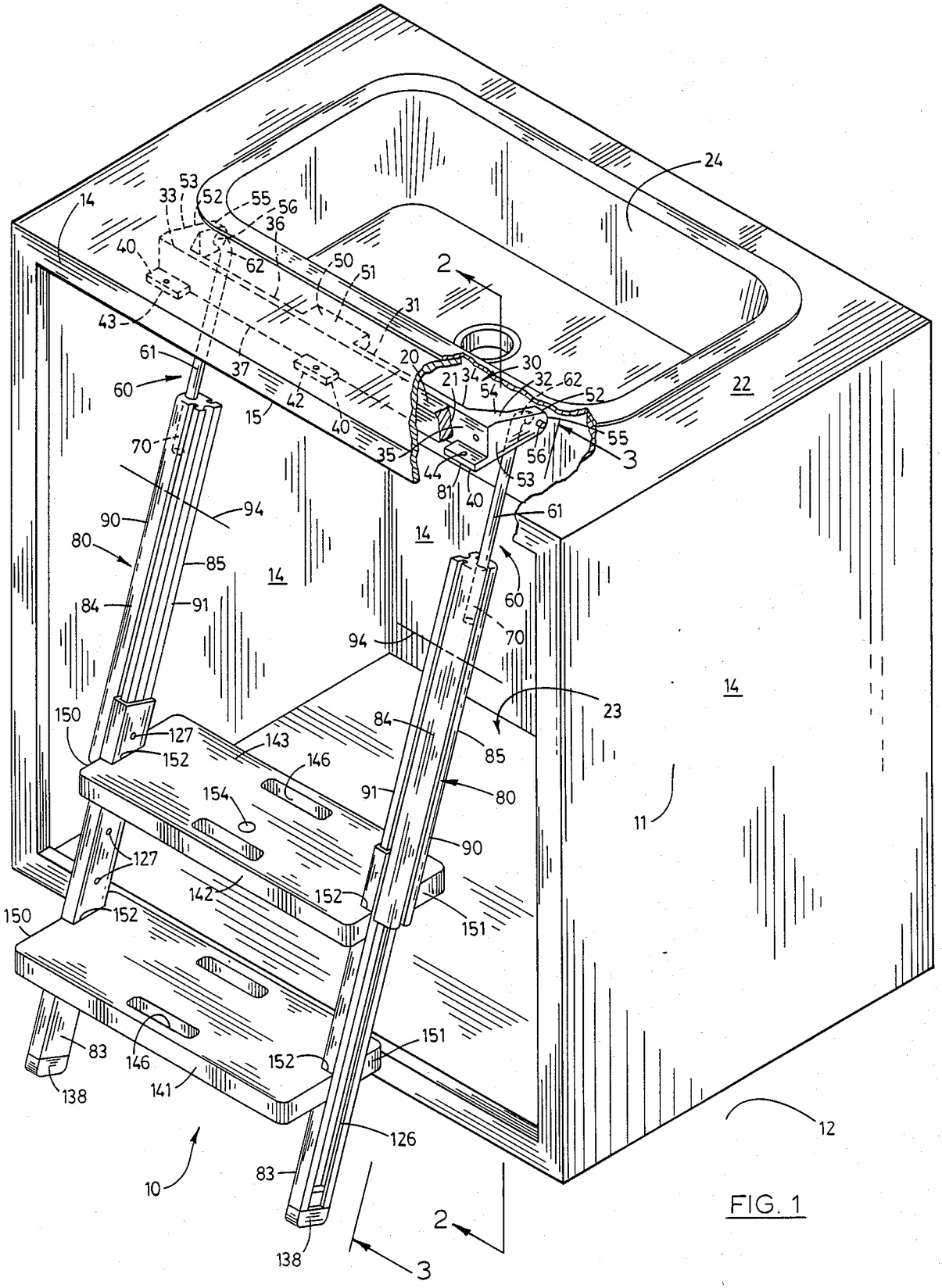
FIG. 1 is a fragmentary perspective view of a cabinet with the doors having been removed for illustrative convenience and with the ladder apparatus of the present invention shown in an installed and deployed configuration.

Referring more particularly to the drawings, the ladder apparatus embodying the principles of the present invention is generally indicated by the numeral 10 in FIG. 1. For illustrative convenience, the apparatus 10, as shown and described herein, is depicted in a typical operative environment where it is mounted inside a fixture such as a cabinet 11 of otherwise conventional design. The ladder apparatus of the present invention can be mounted on a variety of types of fixtures including cabinets, cupboards, counters and the like. However, as will become apparent, the ladder apparatus has particular utility when mounted within a cabinet such as cabinet 11 hereinafter to be described. The cabinet is mounted on a supporting surface such as a floor 12. The cabinet has a base 13 is affixed on the supporting surface 12 and a pair of side walls 14 are mounted on the base and are disposed in a substantially normal attitude thereto. The side wall 14 has a leading edge 15.

As best shown in FIG. 1, a substantially horizontally disposed wooden support member 20 is mounted in close proximity to the leading edge 15 of the side wall 14. The support member 20 has an inside surface 21 and is operable to support a counter top 22 of traditional design. The base of the cabinet 13, the side walls 14, and the counter top 22 define an inside storage space 23. The cabinet mounts a sink 24 which extends downwardly into the storage space.

As best illustrated in FIG. 1, the ladder apparatus 10 includes a ferrous metal mounting bracket, generally indicated by the numeral 30 and which is mounted inside the storage space 23 of the cabinet 11. The mounting bracket 30 is affixed, using conventional fasteners, to the inside surface 21 of the wooden support member 20. The mounting bracket 30 has an elongated main body generally indicated by the numeral 31. The main body 31 has opposite first and second ends 32 and 33, respectively, an inside facing surface 34, an outside facing surface 35, a top edge 36 and a bottom edge 37. Mounted on the inside surface 34 and disposed in close proximity to the bottom edge 37 are a plurality of bottom flange members generally indicated by the numeral 40. The bottom flange members, which include first, second and third flange members 41, 42, and 43, respectively, are individually securely mounted on the main body 31 by welding or the like and are disposed in a substantially normal attitude thereto. Further each of the bottom flange members have formed therein an orifice 44 of predetermined dimensions. The individual orifices 44 are operable to receive a wood screw or other fastener, not shown, and which engages the wooden support member 20.

As best illustrated by reference to FIG. 1, a ferrous metal top flange member 50 is mounted on the inside facing surface 34 and is disposed in close proximity to the top edge 36. The top flange member 50 is disposed in a substantially normal attitude with respect to the main body 31 and further has a top surface 51. The top surface 51 rests against the bottom of the counter top 22. The mounting bracket 30 has a pair of arms 52 which are individually mounted on the opposite ends 32 and 33 thereof. The pair of arms each have a main body 53 which includes a thickened midportion 54 and a distal end 55. Formed in a predetermined location in the distal ends of each of the arms is an orifice 56. As best illustrated by reference to FIG. 2, an angulated channel 57 is formed in each of the thickened midportions 54 and permits the installer to insert a suitable wood screw or other fastener therein. The fastener, of course, engages the wooden support member 20. In this fashion, the mounting bracket is securely fastened to the wooden support member in a predetermined location in the storage space 23. The mounting bracket 30 and the portions thereof heretofore described are preferably of a cast ferrous metal. As best shown in FIG. 1, the top flange member 50 has an oblique or sloping lower surface 58. As previously noted, the top flange member is a ferrous metal being an integral part of the mounting bracket. However, if the top flange member is constructed of a different material, a ferrous metal plate, not shown, is mounted on the lower surface 58 thereof.

A pair of first support members, which are generally indicated by the numeral 60, individually are mounted on the mounting bracket 30 for substantially individual pivotal motion about each of the arms 52. Each of the first support members has an elongated main body 61 with a curved first end 62. The curved first ends have reduced diameter portions 63 which are individually rotatably received in each of the orifices 56. Further, a flange 64 is formed about the first end and defines a space which is operable to receive a retaining clip 65. The retaining clip 65, of course, secures the individual first support members for rotatable movement about each of the arms. This is illustrated most clearly by reference to FIGS. 1 and 3.

Figure 4:
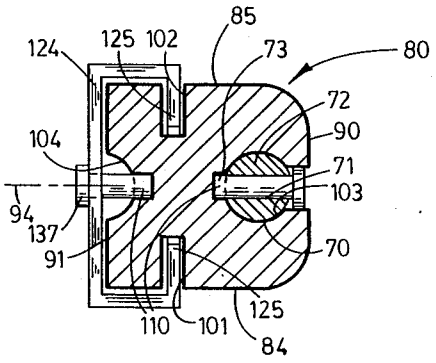
FIG. 4 is a somewhat enlarged transverse section taken on line 4—4 in FIG. 2.

The pair of first support members each has individual second ends 70. As best shown in FIG. 4, a channel 71 of suitable dimension is individually formed in the second end of each of the first support members and is operable slidably to receive a pin or post generally indicated by the numeral 72. The post 72 has a distal end 73 which protrudes slightly beyond the channel 71. This aspect of the invention will be discussed in greater detail hereinafter.

A second pair of support members, which are generally indicated by the numeral 80, are individually slidably mounted on the first support members 60 for substantially coaxial movement therewith. Each of the second support members has an elongated main body 81 and a first end 82 and a second end 83. Each of the main bodies 81 has a forwardly facing, a rearwardly facing, an outwardly facing, and an inwardly facing exterior surface generally indicated by the numerals 84, 85, 90 and 91, respectively. Moreover, the main body of each of the support members has a longitudinal axis 93 and a transverse axis, generally indicated by the line labeled 94. As best illustrated by reference to FIG. 4, a plurality of longitudinally disposed channels 100 individually are formed in the several exterior surfaces 84, 85, 90 and 91, respectively. More particularly, a first and second channel 101 and 102 are individually formed in the forwardly and rearwardly facing surfaces 84 and 85, respectively. The first and second channels are of substantially uniform depth and are substantially aligned one with the other. The longitudinally disposed channels include a third channel 103 which is formed in the outwardly facing surface 90. The third channel conformably is dimensioned slidably to receive the first support member 60 for substantially coaxial movement with the second support member 80. A fourth channel 104 is formed in the inwardly facing exterior surface 91. The fourth channel is substantially arcuately shaped. A pair of discontinuous movement limiting channels are individually formed in the third and fourth channels 103 and 104, respectively. The movement limiting channels 110 have a first end 111 and a second end 112. The movement limiting channels are of substantially uniform dimension. This is best shown in FIGS. 7 and 8.

A pair of third support members 120 individually are mounted on each of the second support members 80 and are disposed in slidable substantially coaxial alignment therewith. Each of the third support members has a main body 121 which includes a first end 122 and a base or second end 123. The main body 121 further includes a side wall 124 that defines a pair of longitudinally disposed edges which are generally indicated by the numeral 125. The side wall defines a channel or passageway 126 of predetermined dimension which permits each of the third support members slidably to receive a portion of the individual second support members 80. The longitudinally disposed edges 125 are spaced a predetermined distance apart sufficient to permit the individual edges matingly to be received in the first and second channels 101 and 102, respectively. This is illustrated most clearly in FIG. 4. This particular arrangement permits slidable, substantially coaxial movement with the individual second support members.

A plurality of orifices, which are generally indicated by the numeral 127, individually are formed in predetermined positions substantially longitudinally along the main body 121 of the individual third support members 120. More particularly, the plurality of orifices include first and second step mounting holes 130 and 131 and a first, second, third and fourth adjustment orifices 132, 133, 134 and 135, respectively. A base mounting hole 136 is formed in close proximity to the base or second end 123. The first and second mounting orifices permit a suitable fastener, not shown, to be inserted therethrough. The fasteners are operable to engage a step for purposes of fastening it in a predetermined position relative to the pair of third support members. The step will hereinafter be discussed in further detail. The first, second, third and fourth adjustment orifices individually are operable selectively to receive a pin or post 137 which is dimensioned slidably to be received in the individual movement limiting channels 110 which are formed in each of the inwardly facing exterior surfaces 91 of each of the second support members 80.

The post 137 limits the coaxial movement of the individual third support members relative to the second support members by engaging the first end 111 of each of the movement limiting channels 110. In like fashion, the post 72, and in particular its distal end 73 thereof, is disposed in slidable receipt in the movement limiting channels formed in the outwardly facing surfaces 90 and is operable to limit the coaxial movement of the individual first support members relative to the second support members. Further the adjustment orifices permit the ladder apparatus 10 to be disposed in the same operational configuration each time it is used. This of course permits a child to use the ladder apparatus in complete safety. A plug or end piece, generally indicated by the numeral 138 is dimensioned slidably to be received in the channel or passageway 126 at the second end 123 of the individual third support members 120. This plug, or end piece is adapted to rest on the supporting surface 12.

A pair of steps, which are generally indicated by the numeral 140 includes a first step 141 and a second step 142 of substantially identical dimension. Each of the steps has a main body 143 which can be manufactured from a variety of different edge 145. A pair of elongated openings 146 are individually disposed in close proximity to the leading and trailing edges 144 and 145, respectively, and provide convenient hand grips. Further, the main body of each step has a left edge and a right edge 150 and 151, respectively. Formed in predetermined positions in the left and right edges are angulated recessed areas 152 and 153, respectively, of predetermined dimensions. The recessed areas are individually dimensioned slidably to receive the individual third support members on which they are mounted by suitable screws and thereby operable to position the individual steps in predetermined operable attitudes when the apparatus 10 is positioned for use in an operational attitude outside of the cabinet 11 as shown in FIG. 1. A magnet 154 is mounted in the second step 142 facing upwardly.

In installations in which there is sufficient under counter room and it is desired to elevate the ladder apparatus to a greater height in the stored position, the magnet 154 can alternatively be mounted in the first step 142 and the top flange number 51 mounted on the underside of the mounting bracket 30 with a sloping lower surface 58 of a suitable angle. In this arrangement in the stored position the first step is held in engagement with the lower surface 58 and the second step is disposed in the stored position well above the mounting bracket under the counter top 22. This maximizes the available space beneath the ladder apparatus for access to the inside storage space 23 of the cabinet 13.

OPERATION

The operation of the described embodiment of the present invention is believed to be readily apparent and is briefly summarized at this point. The ladder apparatus, when installed in the cabinet 11 as described, is always available for use deployed in the extended operational configuration shown in FIGS. 1 and 2. However, when not in use it can be slidably collapsed or retracted and pivoted inwardly to the stored position shown in FIG. 2. In this stored position, the magnet 154 engages the lower surface 58 of the top flange member 50 magnetically to retain the ladder apparatus in this stored configuration. When the ladder apparatus is in the stored position the interior storage space 23 of the cabinet is fully available for use.

Figure 2:
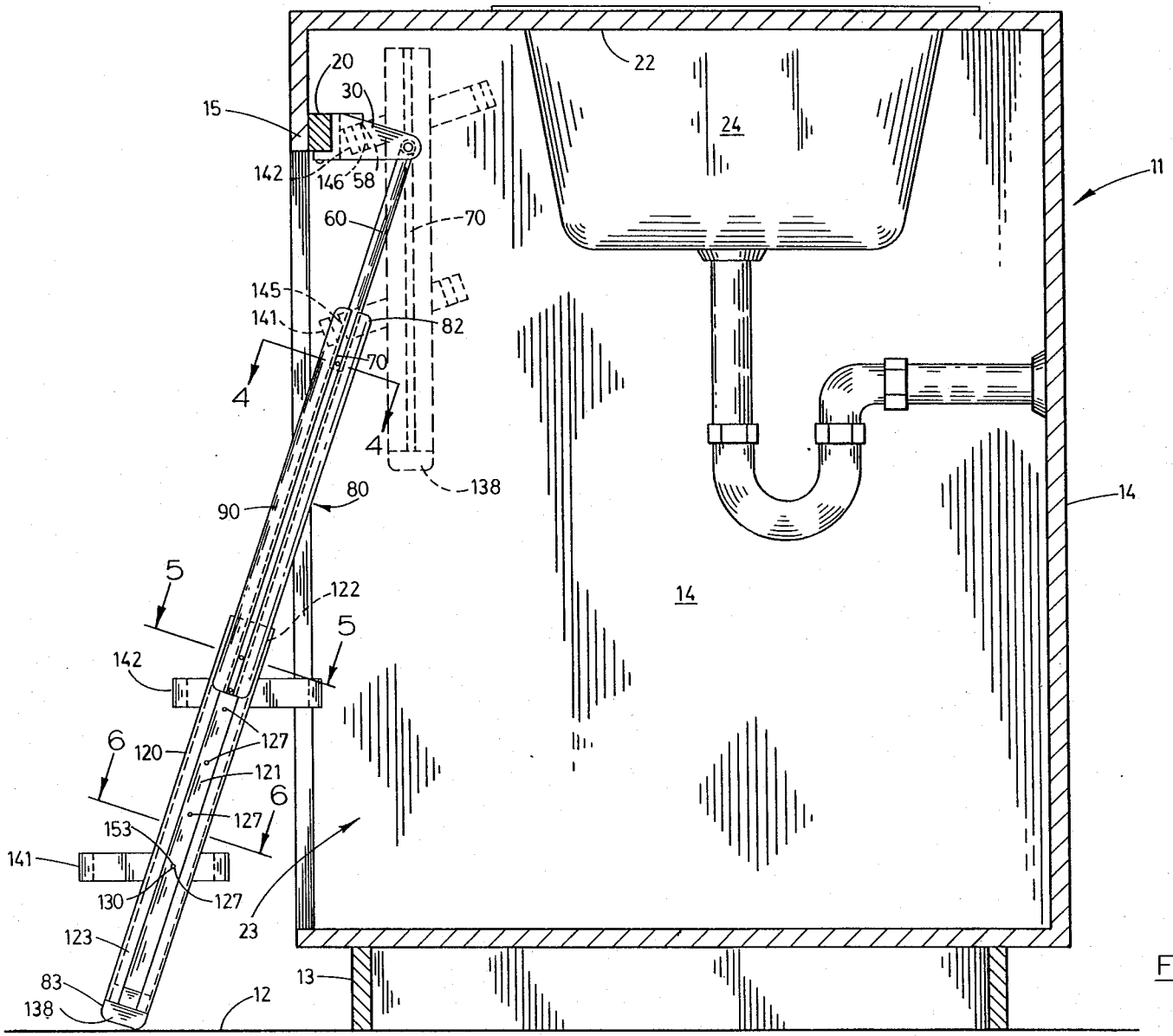
FIG. 2 is a transverse vertical section taken from a position by line 2—2 in FIG. 1 and showing the ladder apparatus in a retracted position in phantom lines and in a deployed position in full lines.
Figure 6:
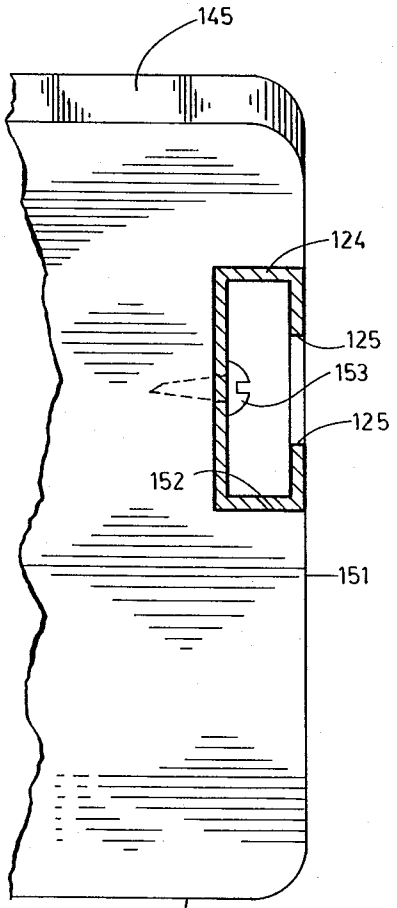
FIG. 6 a somewhat enlarged transverse section taken on line 6—6 in 2.
Figure 5:
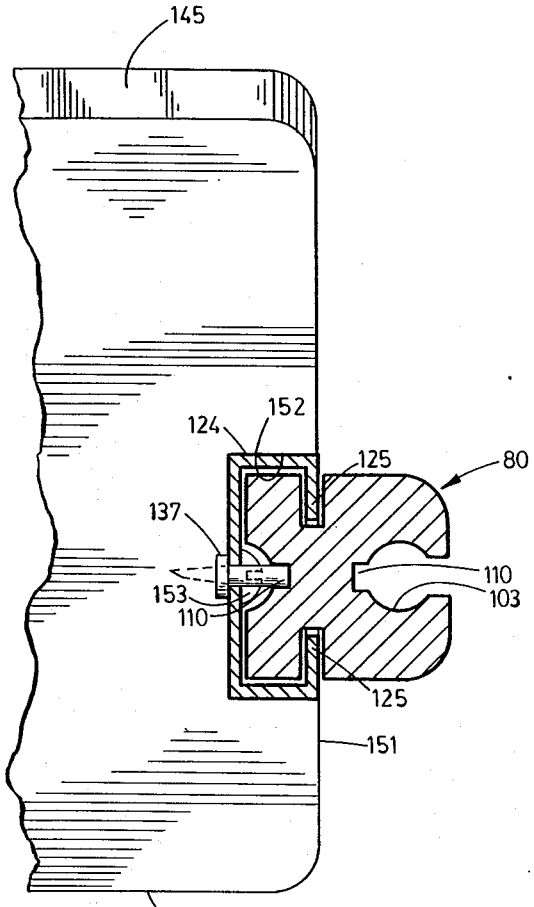
FIG. 5 is a somewhat enlarged transverse section taken on line 5—5 in FIG. 2.

As can perhaps best be visualized in FIG. 2, when a child or other person wishes to use the ladder apparatus, the elongated openings 146 which serve as hand grips are conveniently deployed for grasping. The operator simply reaches into the cabinet, grasps one of the steps 141 or 142 by extending the hand through the accessible opening and pulls downwardly and outwardly. The opening 146 of step 141 is probably most convenient for this purpose and provides greater leverage in that it is farthest from the pivot point of the ladder apparatus. Pulling outwardly and downwardly pivots the ladder apparatus to the extended position shown in FIG. 2 and slides the first, second and third pair of support members 60, 80 and 120 relative to each other. The end pieces 138 are positioned in rested relation on the supporting surface 12 as shown in FIG. 2.

In this configuration the ladder apparatus 10 supports the steps 141 and 142 securely in the horizontal attitudes shown in FIG. 2. The user then simply climbs the steps as desired to gain access to the elevated area. As previously described, the pin 137 can be repositioned in the adjustment orifices 133, 134 and 135 as desired to control the length to which the ladder apparatus can be extended. This permits the extended length of the ladder apparatus to be adjusted to reach a floor surface from cabinets of a variety of heights, or, more particularly, from wooden support members 20 of different heights in particular cabinets. The ladder apparatus is returned to the stored position shown in FIG. 2 simply by reversing the procedure already described.

Therefore, the ladder apparatus of the present invention provides a novel means by which a child or other individual can reach elevated areas in safety and which further provides a means by which the apparatus can be stored in a concealed, compact configuration until it is needed. Furthermore, the apparatus is easy to utilize and is quite stable, making it excellent for use by children.

Although the invention has been herein shown and described in what is conceived to be the most practical and preferred embodiment, it is recognized that departures may be made therefrom within the scope of the invention which is not to be limited to the illustrative details disclosed.

Having described our invention, what we claim as new and desire to be secured by Letters Patent is:

1. A ladder apparatus adapted to be borne by a fixture comprising a bracket adapted to be mounted on the fixture; a first support member substantially pivotally mounted on the bracket; a second support member slidably mounted on the first support member for movement therealong, the second support member having an elongated main body with substantially forwardly facing, rearwardly facing, inwardly facing, and outwardly facing exterior surfaces, and a longitudinally disposed channel formed in each of said surfaces; and a third support member mounting a step slidably mounted on the second support member and disposed in substantial alignment therewith, said channels formed in the forwardly facing, rearwardly facing, and inwardly facing surfaces of the second support member slidably receiving the third support member for movement longitudinally thereof and the channel formed in the outwardly facing surface dimensioned slidably to receive the first support member for movement longitudinally thereof whereby the apparatus can be disposed in a collapsed attitude for storage on the fixture or, alternatively, in an operational attitude extending from the fixture for use in gaining access to an elevated area.

2. The apparatus of claim 1 wherein a pair of channels are individually formed in said inwardly and outwardly facing surfaces respectively, and a pair of projections are individually mounted on the first and third support members respectively, and are individually slidably received in said channels to limit the movement of the first and third support members relative to the second support member.

3. The apparatus of claim 2 wherein the first and third support members are disposed in a substantially retracted attitude relative to the second support member when the apparatus is disposed in the collapsed attitude, and the first and third support members are disposed in extended attitudes relative to the second support member when the apparatus is disposed in the operational attitude.

4. A ladder apparatus adapted to be mounted inside a cabinet or the like comprising:

a bracket adapted to be mounted inside the cabinet and having an elongated main body with opposite ends and a pair of arms individually mounted on the opposite ends of the main body;

a pair of elongated first support members individually mounted on the arms for substantially pivotal movement;

a pair of second support members each having an elongated main body and a longitudinal axis individually, slidably mounted on the first support members for substantially slidable movement longitudinally thereof;

a pair of third support members each having an elongated main body individually slidably mounted on the second support members for substantially slidable movement longitudinally thereof; and at least one step mounted on and interconnecting the pair of third support members, whereby the first and third support members can be disposed in substantially retracted attitudes relative to the second support members in a stored attitude in the cabinet, and alternatively the first support members can be pivoted outwardly of the cabinet and the first and third support members disposed in substantially extended attitudes relative to the second support members permitting the apparatus to be disposed in an operational attitude in which said step is disposed outside of the cabinet for use by a person in gaining access to the area above the cabinet.

5. The apparatus of claim 4 wherein each second support member has an elongated body with substantially forwardly facing, rearwardly facing, inwardly facing, and outwardly facing exterior surfaces, and a channel is formed in each of said surfaces extending longitudinally thereof, and wherein the channels formed in the forwardly facing, rearwardly facing, and inwardly facing surfaces slidably receive the third support member for movement longitudinally thereof and the channel formed in the outwardly facing surface slidably receives the first support member for movement longitudinally thereof.

6. The apparatus of claim 5 wherein a pair of movement limiting channels are individually formed in said inwardly and outwardly facing surfaces respectively and a pair of projections are individually mounted on the first and third support members respectively, and are individually slidably received in the movement limiting channels to limit movement of the first and third support members relative to the second support members.

7. A ladder apparatus adapted to be mounted on a cabinet or the like having an interior compartment with an upper interior surface and a lower interior surface, the ladder apparatus comprising a mount adapted to be mounted on the cabinet adjacent to said upper interior surface thereof; a first support member substantially pivotally mounted on the mount; and a second support member slidably mounted on the first support member for movement therealong between a deployed position wherein the second support member is extended from the cabinet for use by a person in gaining access to an elevated area and a collapsed position wherein said first and second supports are disposed substantially in side-by-side relation received within the cabinet remote from said lower interior surface of the cabinet to leave said interior compartment otherwise substantially unobstructed.

8. The apparatus of claim 7 including means for magnetically retaining the second support in the collapsed position.

9. The apparatus of claim 7 including a third support member slidably mounted on the second support member and receivable substantially in side-by-side relation with the first and second support members in said collapsed position.

10. The apparatus of claim 9 including a pair of steps mounted on the third support member.

11. The apparatus of claim 10 wherein the third support member has a remote end portion engageable with a floor surface in said deployed position.

* * * * *

UNITED STATES PATENT AND TRADEMARK OFFICE

CERTIFICATE OF CORRECTION

PATENT NO. : 4,924,970

DATED : May 15, 1990

INVENTOR(S) : William L. Seals; Brad A. Seals

It is certified that error appears in the above-identified patent and that said Letters Patent is hereby corrected as shown below:

Column 3, Line 12

Insert the word ---which--- between "13" and "is"

Column 5, Line 62

Insert the words ---materials and which further has a leading edge 144 and a trailing--- between "different" and "edge"

Signed and Sealed this Ninth Day of July, 1991

*Attest:*

*Attesting Officer*

HARRY F. MANBECK, JR.

*Commissioner of Patents and Trademarks*